US006627596B1

(12) United States Patent
Kandasamy et al.

(10) Patent No.: US 6,627,596 B1
(45) Date of Patent: Sep. 30, 2003

(54) CATIONIC PARTICLE AND A PROCESS FOR MAKING THEREOF

(75) Inventors: Manivannan Kandasamy, Kobe (JP); Kenji Naemura, Hyogo (JP); Daniel James Dufton, Newcastle upon Tyne (GB); Eric San Jose Robles, Kobe (JP); Aram Armand Dedeyan, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/890,513

(22) PCT Filed: Feb. 1, 1999

(86) PCT No.: PCT/US99/02082

§ 371 (c)(1),
(2), (4) Date: Jul. 31, 2001

(87) PCT Pub. No.: WO00/44874

PCT Pub. Date: Aug. 3, 2000

(51) Int. Cl.[7] ..... C11D 11/00; C11D 11/02; C11D 17/00

(52) U.S. Cl. ..... 510/444; 510/438; 510/443; 510/452; 510/504; 510/511

(58) Field of Search ..... 510/444, 438, 510/443, 452, 504, 507, 511

(56) References Cited

U.S. PATENT DOCUMENTS

| | | | | | |
|---|---|---|---|---|---|
| 4,321,165 | A | * | 3/1982 | Smith et al. | 510/350 |
| 4,347,168 | A | * | 8/1982 | Murphy et al. | 510/452 |
| 4,664,848 | A | * | 5/1987 | Oh et al. | 510/350 |
| 5,108,617 | A | * | 4/1992 | Eriksson et al. | 210/679 |
| 5,496,486 | A | * | 3/1996 | Staley | 510/441 |
| 5,705,473 | A | * | 1/1998 | Kuroda et al. | 510/441 |

FOREIGN PATENT DOCUMENTS

| | | | |
|---|---|---|---|
| WO | WO 97/03154 A2 | * | 1/1997 |
| WO | WO 98/13453 | | 4/1998 |

* cited by examiner

*Primary Examiner*—Lorna M. Douyon
(74) *Attorney, Agent, or Firm*—Laura M. Grunzinger; Kim W. Zerby; Steven W. Miller

(57) ABSTRACT

The present invention relates to a cationic particle containing an aqueous cationic surfactant solution adsorbed to a water-insoluble high absorbing material. Preferably, the water-insoluble high absorbing material has an oil absorption (using d-butyl phthalate) of from about 140 mL/100 g to about 400 mL/100 g. A process for making the cationic particle is also described herein. The cationic particle can be incorporated into a particulate detergent composition.

7 Claims, No Drawings

CATIONIC PARTICLE AND A PROCESS FOR MAKING THEREOF

This application claims priority under 35 U.S.C. §371 to WO 00/44874, filed Feb. 1, 1999.

FIELD

The present invention relates to a cationic surfactant particle, particulate detergent compositions containing such cationic particle, and a process for making thereof.

BACKGROUND

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, the extent to which modem detergent products need to be "compact" in nature remains unsettled. In fact, many consumers, especially in developing countries, continue to prefer a higher dosage levels in their respective laundering operations. Consequently, there is a need in the art of producing modem detergent compositions for flexibility in the ultimate density of the final composition.

Currently, the relative amounts and types of materials subjected to processes in the production of detergent granules has been limited. For example, it has been difficult to attain high levels of surfactant in the resulting detergent composition, a feature which facilitates production of detergents in a more efficient manner. Cationic surfactants are a common surfactant as well as co-surfactant for use in detergent compositions and is commonly available in a liquid form. In general, detergent compositions will contain one or more types of surfactants which are designed to loosen and remove different types of soils and stains.

Based on the foregoing, there is a need for a cationic surfactant material which is in a form that is easily incorporated into particulate detergent compositions. None of the existing art provides all of the advantages and benefits of the present invention.

SUMMARY

The present invention relates to a cationic particle containing an aqueous cationic surfactant solution adsorbed to a water-insoluble high absorbing material. A process for making the cationic particle is also described herein. These and other features, aspects, and advantages of the present invention will become evident to those skilled in the art from a reading of the present disclosure.

DETAILED DESCRIPTION

While this specification concludes with claims distinctly pointing out and particularly claiming that which is regarded as the invention, it is believed that the invention can be better understood through a careful reading of the following detailed description of the invention. In this specification, all percentages, ratios, and proportions are by weight, all temperatures are expressed in degrees Celsius, molecular weights are in weight average, and the decimal is represented by the point (.), unless otherwise indicated.

As used herein, "comprising" means that other steps and other ingredients which do not affect the end result can be added. This term encompasses the terms "consisting of" and "consisting essentially of".

All cited references are incorporated herein by reference in their entireties. Citation of any reference is not an admission regarding any determination as to its availability as prior art to the claimed invention.

The present invention relates to a cationic particle containing an aqueous cationic surfactant solution adsorbed to a water-insoluble high absorbing material. It is beneficial to have the cationic surfactant in a particulate form for various reasons, since cationic surfactants are commonly available in liquid solution form. For example, in processing particulate detergent compositions in non-tower processes, the liquid cationic surfactant may make the mixture during agglomeration sticky due to the excess moisture. In addition, the cationic particle can be made a higher active particle, as compared to its liquid form, which provides formula space when formulating a particulate detergent composition. In addition, the cationic particle of the present invention has good dispersion and solubility when used in the wash water.

The present invention also meets the aforementioned needs in the art by providing a cationic particle which can be used to produce a particulate detergent composition for flexibility in the ultimate density of the final composition.

As used herein, the term "mean residence time" refers to following definition: "mean residence time (hr)=mass (kg)/flow throughput (kg/hr)".

Cationic Surfactant Solution

The cationic particle of the present invention contains an aqueous cationic surfactant solution. The cationic surfactant solution has at least about 70% water, preferably from about 40% to about 60%, more preferably from about 50% to about 60%, by weight of the surfactant solution. The amount of cationic active in the aqueous cationic surfactant solution is at least about 30%, preferably from about 40% to 60%, more preferably from about 40% to 50%.

Preferably the cationic surfactant is selected from the group consisting of cationic ester surfactants, cationic mono-alkoxylated amine surfactants, cationic bis-alkoxylated amine surfactants and mixtures thereof. Preferred quaternary ammonium surfactants are selected from mono $C_1$–$C_{30}$, preferably $C_6$–$C_{16}$ N-alkyl or alkenyl ammonium surfactants wherein remaining N positions are substituted by methyl, hydroxyethyl or hydroxypropyl groups.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$, and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocoalkyl trimethyl ammonium methosulfate.

Cationic surfactants also useful is a cationic choline ester-type quat surfactant which are preferably water dispersible compounds having surfactant properties and comprise at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529.

Preferred cationic ester surfactants are those having the formula:

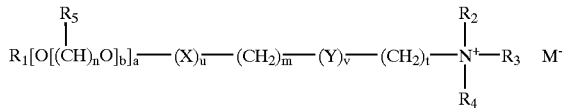

wherein $R_1$ is a $C_5$–$C_{31}$ linear or branched alkyl, alkenyl or alkaryl chain or $M^-.N^+(R_6R_7R_8)(CH_2)_s$; X and Y, independently, are selected from the group consisting of COO, OCO, O, CO, OCOO, CONH, NHCO, OCONH and NHCOO wherein at least one of X or Y is a COO, OCO, OCOO, OCONH or NHCOO group; $R_2$, $R_3$, $R_4$, $R_6$, $R_7$ and $R_8$ are independently selected from the group consisting of alkyl, alkenyl, hydroxyalkyl, hydroxyalkenyl and alkaryl groups having from 1 to 4 carbon atoms; and $R_5$ is independently H or a $C_1$–$C_3$ alkyl group; wherein the values of m, n, s and t independently lie in the range of from 0 to 8, the value of b lies in the range from 0 to 20, and the values of a, u and v independently are either 0 or 1 with the proviso that at least one of u or v must be 1; and wherein M is a counter anion.

Preferably $R_2$, $R_3$ and $R_4$ are independently selected from $CH_3$ and —$CH_2CH_2OH$.

Preferably M is selected from the group consisting of halide, methyl sulfate, sulfate, and nitrate, more preferably methyl sulfate, chloride, bromide or iodide.

Preferred water dispersible cationic ester surfactants are the choline esters having the formula:

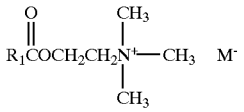

wherein $R_1$ is a $C_{11}$–$C_{19}$ linear or branched alkyl chain.

Particularly preferred choline esters of this type include the stearoyl choline ester quatemary methylammonium halides ($R^1$=$C_{17}$ alkyl), palmitoyl choline ester quaternary methylammonium halides ($R^1$=$C_{15}$ alkyl), myristoyl choline ester quatemary methylammonium halides ($R^1$=$C_{13}$ alkyl), lauroyl choline ester quaternary methylammonium halides ($R^1$=$C_{11}$ alkyl), cocoyl choline ester quaternary methylammonium halides ($R^1$=$C_{11}$–$C_{13}$ alkyl), tallowyl choline ester quatemary methylammonium halides ($R^1$=$C_{15}$–$C_{17}$ alkyl), and any mixtures thereof.

The particularly preferred choline esters, given above, may be prepared by the direct esterification of a fatty acid of the desired chain length with dimethylaminoethanol, in the presence of an acid catalyst. The reaction product is then quatemized with a methyl halide, preferably in the presence of a solvent such as ethanol, propylene glycol or preferably a fatty alcohol ethoxylate such as $C_{10}$–$C_{18}$ fatty alcohol ethoxylate having a degree of ethoxylation of from 3 to 50 ethoxy groups per mole forming the desired cationic material. They may also be prepared by the direct esterification of a long chain fatty acid of the desired chain length together with 2-haloethanol, in the presence of an acid catalyst material. The reaction product is then quaternized with trimethylamine, forming the desired cationic material.

Other suitable cationic ester surfactants have the structural formulas below, wherein d may be from 0 to 20.

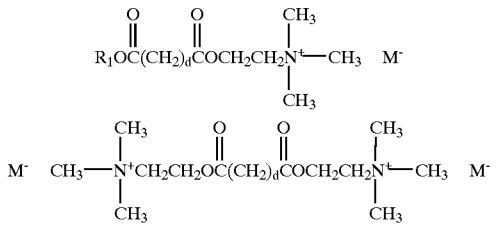

In a preferred aspect these cationic ester surfactant are hydrolysable under the conditions of a laundry wash method.

Cationic surfactants useful herein also include alkoxylated quatemary ammonium (AQA) surfactant compounds (referred to hereinafter as "AQA compounds") having the formula:

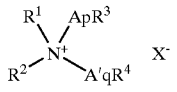

I wherein $R^1$ is a linear or branched alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl; X– is an anion such as chloride, bromide, methylsulfate, sulfate, or the like, sufficient to provide electrical neutrality. A and A' can vary independently and are each selected from $C_1$–$C_4$ alkoxy, especially ethoxy (i.e., —$CH_2CH_2O$—), propoxy, butoxy and mixed ethoxy/propoxy; p is from 0 to about 30, preferably 1 to about 4 and q is from 0 to about 30, preferably 1 to about 4, and most preferably to about 4; preferably both p and q are 1. See also: EP 2,084, published May 30, 1979, by The Procter & Gamble Company, which describes cationic surfactants of this type which are also useful herein.

AQA compounds wherein the hydrocarbyl substituent $R^1$ is $C_8$–$C_{11}$, especially $C_{10}$, enhance the rate of dissolution of laundry granules, especially under cold water conditions, as compared with the higher chain length materials. Accordingly, the $C_8$–$C_{11}$ AQA surfactants may be preferred by some formulators. The levels of the AQA surfactants used to prepare finished laundry detergent compositions can range from about 0.1% to about 5%, typically from about 0.45% to about 2.5%, by weight.

According to the foregoing, the following are nonlimiting, specific illustrations of AQA surfactants used herein. It is to be understood that the degree of alkoxylation noted herein for the AQA surfactants is reported as an average, following common practice for conventional ethoxylated nonionic surfactants. This is because the ethoxylation reactions typically yield mixtures of materials with differing degrees of ethoxylation. Thus, it is not uncommon to report total EO values other than as whole numbers, e.g., "EO2.5", "EO3.5", and the like.

| Designation | $R^1$ | $R^2$ | $ApR^3$ | $A'qR^4$ |
|---|---|---|---|---|
| AQA-1 (also referred to as Coco Methyl EO2) | $C_{12}$—$C_{14}$ | $CH_3$ | EO | EO |
| AQA-2 | $C_{12}$—$C_{16}$ | $CH_3$ | $(EO)_2$ | EO |
| AQA-3 (Coco Methyl EO4) | $C_{12}$—$C_{14}$ | $CH_3$ | $(EO)_2$ | $(EO)_2$ |
| AQA-4 | $C_{12}$ | $CH_3$ | EO | EO |
| AQA-5 | $C_{12}$—$C_{14}$ | $CH_3$ | $(EO)_2$ | $(EO)_3$ |
| AQA-6 | $C_{12}$—$C_{14}$ | $CH_3$ | $(EO)_2$ | $(EO)_3$ |
| AQA-7 | $C_8$—$C_{18}$ | $CH_3$ | $(EO)_3$ | $(EO)_2$ |
| AQA-8 | $C_{12}$—$C_{14}$ | $CH_3$ | $(EO)_4$ | $(EO)_4$ |
| AQA-9 | $C_{12}$—$C_{14}$ | $C_2H_5$ | $(EO)_3$ | $(EO)_3$ |
| AQA-10 | $C_{12}$—$C_{18}$ | $C_3H_7$ | $(EO)_3$ | $(EO)_4$ |
| AQA-11 | $C_{12}$—$C_{18}$ | $CH_3$ | (propoxy) | $(EO)_3$ |
| AQA-12 | $C_{10}$—$C_{18}$ | $C_2H_5$ | $(iso\text{-}propoxy)_2$ | $(EO)_3$ |
| AQA-13 | $C_{10}$—$C_{18}$ | $CH_3$ | $(EO/PO)_2$ | $(EO)_3$ |
| AQA-14 | $C_8$—$C_{18}$ | $CH_3$ | $(EO)_{15}$* | $(EO)_{15}$* |
| AQA-15 | $C_{10}$ | $CH_3$ | EO | EO |
| AQA-16 | $C_8$—$C_{12}$ | $CH_3$ | EO | EO |
| AQA-17 | $C_9$—$C_{11}$ | $CH_3$ | - EO 3.5 Avg. - | |

-continued

| Designation | $R^1$ | $R^2$ | $ApR^3$ | $A'qR^4$ |
|---|---|---|---|---|
| AQA-18 | $C_{12}$ | $CH_3$ | - EO 3.5 Avg. - | |
| AQA-19 | $C_8$—$C_{14}$ | $CH_3$ | $(EO)_{10}$ | $(EO)_{10}$ |
| AQA-20 | $C_{10}$ | $C_2H_5$ | $(EO)_2$ | $(EO)_3$ |
| AQA-21 | $C_{12}$—$C_{14}$ | $C_2H_5$ | $(EO)_5$ | $(EO)_3$ |
| AQA-22 | $C_{12}$—$C_{18}$ | $C_3H_7$ | Bu | $(EO)_2$ |
| AQA-23 | $C_8$—$C_{10}$ | $CH_3$ | $CH_3$ | $CH_2$ $CH_2OH$ |

*Ethoxy, optionally end-capped with methyl or ethyl.

The preferred bis-ethoxylated cationic surfactants herein are available under the trade name ETHOQUAD from Akzo Nobel Chemicals Company.

Highly preferred bis-AQA compounds for use herein are of the formula

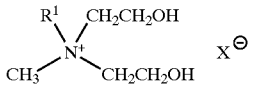

wherein $R^1$ is $C_{10}$–$C_{18}$ hydrocarbyl and mixtures thereof, preferably $C_{10}$, $C_{12}$, $C_{14}$ alkyl and mixtures thereof, and X is any convenient anion to provide charge balance, preferably chloride. With reference to the general AQA structure noted above, since in a preferred compound $R^1$ is derived from coconut ($C_{12}$–$C_{14}$ alkyl) fraction fatty acids, $R^2$ is methyl and $ApR^3$ and $A'qR^4$ are each monoethoxy, this preferred type of compound is referred to herein as "CocoMeEO2" or "AQA-1" in the above list.

Other preferred AQA compounds herein include compounds of the formula:

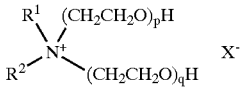

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride.

Other compounds of the foregoing type include those wherein the ethoxy ($CH_2CH_2O$) units (EO) are replaced by butoxy (Bu), isopropoxy [$CH(CH_3)CH_2O$] and [$CH_2CH(CH_3O$] units (i-Pr) or n-propoxy units (Pr), or mixtures of EO and/or Pr and/or i-Pr units.

Additional cationic surfactants are described, for example, in the "Surfactant Science Series, Volume 4, Cationic Surfactants" or in the "Industrial Surfactants Handbook". Classes of useful cationic surfactants described in these references include amide quats (i.e., Lexquat AMG & Schercoquat CAS), glycidyl ether quats (i.e., Cyostat 609), hydroxyalkyl quats (i.e., Dehyquart E), alkoxypropyl quats (i.e., Tomah Q-17-2), polypropoxy quats (Emcol CC-9), cyclic alkylammonium compounds (i.e., pyridinium or imidazolinium quats), and/or benzalkonium quats.

High Absorbing Material

The cationic particle of the present invention also contains a water-insoluble high absorbing material. The water-insoluble high absorbing material is a material having an oil absorption (using di-butyl phthalate) of preferably from about 140 mL/100 g to about 400 mL/100 g, even more preferably from about 200 mL/100 g to about 300 mL/100 g.

Preferably, the high absorbing material is selected from the group consisting of aluminosilicate, precipitated silica, amorphous silica, talc, and mixtures thereof.

Especially preferred are sodium aluminosilicates and amorphous precipitated silica. An example of an amorphous precipitated silica is a porous hydrophyllic silica (trademark SIPERNAT 22S) available by DeGussa. Another example of a precipitated silica is a white carbon, such as calcium silicate synthetic amorphous silica, (trademark Carplex) available by Shionogi and Company Ltd.

In a preferred cationic particle, the ratio of the high absorbing material to the cationic surfactant active when forming the particle is from about 1:3 to about 1:1, even more preferably from about 1:2 to about 1:1. Absorption here means that the high absorbing material is coated with the cationic surfactant solution, and/or that the high absorbing material is impregnated with the cationic surfactant solution.

The finished cationic particle preferably has a mean particle size of greater than about 100 microns, and more preferably from about 100 microns to about 1000 microns, even more preferably from about 150 microns to about 650 microns.

A preferred finished cationic particle has the following composition, by weight percent of the cationic particle: cationic surfactant active from about 30% to about 65%; moisture content of from about 3% to about 15%; and the balance, the high absorbing material. Optionally filler and anionic surfactant may be included.

One embodiment for the cationic particle contain in addition, some anionic surfactant. If included, the ratio of anionic surfactant active to cationic surfactant active is from about 1:10 to about 1:30, preferably from about 1:15 to about 1:25. By weight percentage of the finished cationic particle, the content of anionic surfactant is preferably from about 1% to about 5%. Of course, the anionic surfactant may in addition be included as an additional cleaning component for the final detergent composition. Although not wanting to be limited by theory, it is believed that the addition of small quantities of anionic surfactant in the cationic particle provides free flow characteristics to the cationic particle and provides a less sticky surface on the cationic particle.

The cationic particle optionally also contains a filler, such as soda ash, other silicate, and/or sulfate.

Additional Deteraent Composition Components

The cationic particle may be formulated in detergent compositions. Such detergent compositions herein may optionally comprise other known detergent cleaning components including alkoxylated polycarboxylates, bleaching compounds, brighteners, chelating agents, clay soil removal/anti-redeposition agents, dye transfer inhibiting agents, enzymes, enzyme stabilizing systems, fabric softeners, polymeric soil release agents, polymeric dispersing agents, suds suppressors. The detergent composition may also comprise other ingredients including carriers, hydrotropes, processing aids, dyes or pigments. The preferred detergent compositions have a wide range of density, e.g., from about 300 g/l to about 1000 g/l, especially for high dense detergent agglomerates e.g., from about 600 g/l to about 850 g/l.

The cationic particle can be used to formulate detergent compositions. In such detergent compositions, the amount of cationic particle, by weight of the final detergent composition is preferably from about 0.5% to about 30%, more preferably from about 0.5% to about 10%.

PROCESS

Preferred examples of the process of making the cationic particle of the present invention is described below. In one method of making the cationic particle via a spray drying process, the cationic surfactant solution, high absorbing material, and optionally anionic surfactant and a filler, are mixed and agitated to form a substantially homogenous mixture. The mixture is then sprayed into a tower, wherein cationic particles are formed. In another method of making the cationic particle via an agglomeration process, the cationic surfactant solution is added to the high absorbing material and agitated in a mixer to form a moist granular powder, or agglomerate. The powder is then dried, such as in a fluid bed dryer, to form the finished cationic particle.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention.

In one embodiment, cationic surfactant solution (30–70% active), amorphous precipitated silica, optionally sodium carbonate, optionally sodium linear alkyl benzene sulfonate and water, are mixed in a crutcher tank mix. The mixture is then fed into the spray tower and cationic particles having about 150 microns are formed. The spray tower's drying temperature is about 160° C to 170° C.

In another embodiment, 100 kg/hr of amorphous precipitated silica is fed into a mixer, such as a Loedige KM mixer, and 250 kg/hr of cationic surfactant solution is added to the mixer at one or more points while mixing takes place. The calculated mean residence time in the mixer of the silica is about 1–10 minutes. The moist granules from the mixer are then fed to a fluid bed dryer, where the moisture is removed by warm air at about 100° C. to 150° C., preferably about 115° C. to 130° C. The resultant cationic particles have a mean particle size of about 100 to 1000 microns, preferably 350 to 650 microns. The finished agglomerate particle is free-flowing without the need for additional ingredients.

The following examples show cationic particle compositions of the present invention:

| Example | Ex. 1 | Ex. 2 | Ex. 3 | Ex. 4 | Ex. 5 |
|---|---|---|---|---|---|
| Cationic surfactant A (%) | 50 | 50 | 50 | — | — |
| Cationic surfactant B (%) | — | — | — | 50 | 50 |
| SIPERNAT 22S (%) | 35 | — | 35 | 40 | 35 |
| Carplex 80D (%) | — | 40 | — | — | — |
| NaLAS (%) | 2 | — | — | — | 2 |
| Soda Ash (%) | 8 | 5 | 10 | — | 8 |
| Water (%) | 5 | 5 | 5 | 10 | 5 |

Cationic surfactant A = C12–14 Dimethyl Hydroxyethyl Ammonium Chloride Solution
Cationic surfactant B = C8–10 Dimethyl Hydroxyethyl Ammonium Chloride Solution It is understood that the examples and embodiments described herein are for illustrative purposes only and that various modifications or changes in light thereof will be suggested to one skilled in the art without departing from its spirit and scope.

What is claimed is:

1. A cationic particle, comprising an aqueous cationic surfactant solution adsorbed to a water-insoluble high absorbing material, wherein the high absorbing material is precipitated silica and/or amorphous silica having an oil absorption, using di-buty phthalate, of from about 140 mL/100 g to about 400 mL/100 g and wherein the finished cationic particle has at least about 30% to about 65% by weight cationic active.

2. The cationic particle of claim 1, wherein the ratio of the high absorbing material to the cationic surfactant active is from about 1:3 to about 1:1.

3. The cationic particle of claim 1, wherein the finished cationic particle has a moisture content of from about 3% to about 15%, by weight.

4. The cationic particle of claim 1, wherein the cationic particle further comprises an anionic surfactant at a ratio of anionic surfactant active to cationic surfactant active is from about 1:10 to about 1:30.

5. A detergent composition comprising the cationic particle of claim 1, wherein the density of the detergent composition is from about 300 g/l to about 1000 g/l.

6. A process for making a cationic particle comprising:

a. mixing an aqueous cationic surfactant solution and a water-insoluble high absorbing material, wherein the high absorbing material is precipitated silica and/or amorphous silica having an oil absorption, using di-butyl phthalate, of from about 140 mL/100 g to about 400 mL/100 g coated with the cationic surfactant solution; and b. spraying the mixture of (a) in a tower to form a cationic particle having a mean particle size of greater than about 100 microns; wherein the finished cationic particle has at least about 30% to about 65% by weight cationic active.

7. A process for making a cationic particle comprising:

a. mixing an aqueous cationic surfactant solution and a water-insoluble high absorbing material in a mixer for a mean residence time of from about 1 to 10 minutes in order to form agglomerates, wherein the high absorbing material is precipitated silica and/or amorphous silica having an oil absorption, using di-butyl phthalate, of from about 140 mL/100 g to about 400 mL/100 g, and b. drying the agglomerates of (a) in a dryer to form a cationic particle having a mean particle size of greater than about 100 microns wherein the finished cationic particle has at least about 30% to about 65% by weight cationic active.

* * * * *